US006773478B1

(12) United States Patent
Broering et al.

(10) Patent No.: US 6,773,478 B1
(45) Date of Patent: Aug. 10, 2004

(54) GRAVITY-INDUCED ASH REMOVAL SYSTEM FOR PARTICULATE FILTERS

(75) Inventors: Louis C. Broering, Hope, IN (US); Thomas M. Yonushonis, Columbus, IN (US)

(73) Assignee: Fleetguard, Inc., Nashville, TN (US)

( * ) Notice: Subject to any disclaimer, the term of this patent is extended or adjusted under 35 U.S.C. 154(b) by 104 days.

(21) Appl. No.: 10/115,769

(22) Filed: Apr. 3, 2002

(51) Int. Cl.[7] ..... B01D 46/04

(52) U.S. Cl. ..... 55/385.3; 55/419; 55/420; 55/359; 96/399; 96/407; 123/198 E

(58) Field of Search ..... 55/285.3, 419, 55/420, 359, 385.3; 96/399, 407; 123/198 E

(56) References Cited

U.S. PATENT DOCUMENTS

| | | | | |
|---|---|---|---|---|
| 421,823 A | | 2/1890 | Lindstone et al. | |
| 2,825,317 A | * | 3/1958 | Tacchella et al. | 55/385.3 |
| 4,017,281 A | * | 4/1977 | Johnstone | 55/385.3 |
| 4,080,184 A | * | 3/1978 | Petersen | 55/385.3 |
| 4,452,613 A | | 6/1984 | Littrell | |
| 4,465,498 A | | 8/1984 | Stephenson | |
| 5,053,063 A | | 10/1991 | Sisk | |
| 5,472,463 A | * | 12/1995 | Herman et al. | 55/385.3 |
| 5,738,706 A | | 4/1998 | Swanander et al. | |
| 6,423,108 B1 | * | 7/2002 | Mueller | 55/385.3 |

OTHER PUBLICATIONS

"Cleanable Particulate Filter for Diesel Engines", Press Release from Karlsruhe Research Center, Karlsruhe, Germany, Oct. 25, 1995.

* cited by examiner

*Primary Examiner*—Minh-Chau T. Pham
(74) *Attorney, Agent, or Firm*—Woodard, Emhardt, Moriarty, McNett & Henry LLP

(57) ABSTRACT

An exhaust system for a diesel engine which includes a particulate filter for filtering a flow of engine exhaust gas includes, as part of the exhaust system, a catch basin for the collection of oxidation by-products from the particulate filter. Important in the design is to orient the particulate filter in a generally vertical orientation based upon the normal orientation of the diesel engine when in use. By vibration of the engine due in part to engine operation and due in part to vehicle vibrations, oxidation by-products shake loose from the particulate filter and fall through a connecting conduit. By positioning the catch basin below the particulate filter and connecting it to the conduit, the oxidation by-products are able to be collected in the catch basin for removal at a later time.

11 Claims, 1 Drawing Sheet

GRAVITY-INDUCED ASH REMOVAL SYSTEM FOR PARTICULATE FILTERS

BACKGROUND OF THE INVENTION

The present invention relates generally to the design, installation, and use of particulate filters. More specifically, the present invention relates to the use of such filters for collecting and oxidizing carbonaceous and hydrocarbon compounds that make up particulate exhaust emissions from diesel engines.

The diesel engine is the most efficient power plant among all known types of internal combustion engines. Heavy trucks, urban uses, and industrial equipment are powered almost exclusively by diesel engines all over the world. In Europe, diesel powered cars have been increasingly popular. The diesel engine is a major candidate to become the power plant of the future. However, one of the concerns with regard to diesel engines is emission control and air pollution.

There is no dispute that internal combustion engines contribute to air pollution and have an adverse impact on health and on environmental aspects, such as global warming. This has resulted in a great deal of attention to the quantity and type of emissions from diesel engines. In particular, the emission of nitrogen oxides and diesel particulates are of ever greater concern to diesel engine designers.

In the context of the present invention, a catalyzed diesel filter may be used and an understanding of that technology may be helpful.

The function of the catalyst in a catalyzed diesel particulate filter is to lower the soot combustion temperature in order to facilitate regeneration of the filter by oxidation of accumulated soot under exhaust temperatures experienced during regular operation of the vehicle.

Most catalyzed diesel engine particulate filters utilize monolithic wall-flow substrates which are coated with a catalyst. The catalyst lowers the soot combustion temperature, allowing the filter to effectively "self-regenerate" during periods of high exhaust gas temperature. A number of diesel filter catalysts have been developed, including both noble and base metal formulations.

The desire to construct or design a "cleanable" particulate filter for diesel engines has been present for several years. One development reported in 1995 by the Karlsruhe Research Center of Germany uses a metal fiber material in a form referred to as a "filter candle". As reported, particulate filters for diesel engines must be regenerated at regular intervals in order to keep within tolerable limits the exhaust gas back pressure which rises with increasing particulate loading of the filter. The particulates are removed from the filter by electric heating under excess air conditions which burns a majority of the particulates to carbon dioxide ($CO_2$).

Compared to the "cleanable" filter design of the present invention, this reported electric heating approach is substantially more complicated and costly. In the context of the present invention, the inventors recognized that EPA regulations will require the use of particulate filters to meet legislated levels. As noted, these particulate filters are used to collect and oxidize carbonaceous and hydrocarbon compounds that make up particulate emissions. Over a period of time, the filter also collects the residuals of the oxidation by-products in the form of ash or other deposits that are not combustible. The ash deposits are collected in the filter channels, resulting in a blockage that will not allow the exhaust gases to pass through the filter. The blockage results in excessive exhaust back pressure that reduces engine performance and can lead to engine shutdown.

In order to address these design and performance issues, laboratory tests were conducted involving the use of ceramic filters (cordierite). These filters were operated on actual diesel engines. What the inventors noticed was that, as the test time increases, the pressure drop across the filter increases even after the combustible carbon particles have been burned. Further investigation showed that the non-combustible material that remained were ash deposits that are by-products of the lube oil additives. The additives are metallic compounds and perform a variety of functions in the lubrication of engine parts. All engines burn, to some degree, lube oil during the combustion process and the ash from those additives is captured by the filter.

In the course of testing, the inventors noticed that some of these deposits were shaken loose during engine operation and, as a result, would fall down through the exhaust pipe that is attached to the filter can. The inventors conceived of and reduced to practice a catch basin that allows for the collection and the subsequent removal of that ash for analysis and/or disposal. Based on this testing, the inventors concluded that the ash would fall out of the filter in a similar manner on a vehicle if the particulate filter were installed in a vertical orientation relative to the normal orientation of the vehicle or diesel engine during use. The vibrations that cause the ash to fall out and be deposited in the catch basin are caused by either the engine operation generally or by vehicle vibrations from bumps in the road and related road roughness, all of which combine to produce the shaking loose of ash deposits from the particulate filter. This realization is what led to the present invention. The only remaining issue was how to incorporate this filter into the exhaust system so that a vertical orientation could be realized, while still enabling access to the catch basis for removal of the ash deposits.

The present invention provides a particulate filter for an exhaust system which is equipped with a catch basin that can be easily removed and cleaned by simply disconnecting the catch basin from the balance of the exhaust system. Basic V-type bands or clamps can be used or similar connections that are typical within the exhaust system field. A related option, and a related embodiment of the present invention, is to include an access port or outlet as part of the catch basin with a removable cover so that a shop vacuum cleaner hose can be attached for removal of the ash which is deposited and collected within the catch basin. The particulate filter of the present invention replaces the muffler in a vertical exhaust system which is typically positioned at the rear exterior of the cab.

SUMMARY OF THE INVENTION

An exhaust system for a diesel engine for collection of ash deposits according to one embodiment of the present invention includes a particulate filter for filtering a flow of engine exhaust gas, a catch basin for the collection of oxidation by-products (ash) from the particulate filter, a first conduit connecting the particulate filter to the diesel engine, a second conduit connecting the particulate filter to the catch basin, and a mounting arrangement for connecting the particulate filter in a generally vertical orientation based on the normal orientation of the diesel engine when in use.

One object of the present invention is to provide an improved exhaust system for a diesel engine.

Related objects and advantages of the present invention will be apparent from the following description.

DESCRIPTION OF THE PREFERRED EMBODIMENTS

Figure 1:
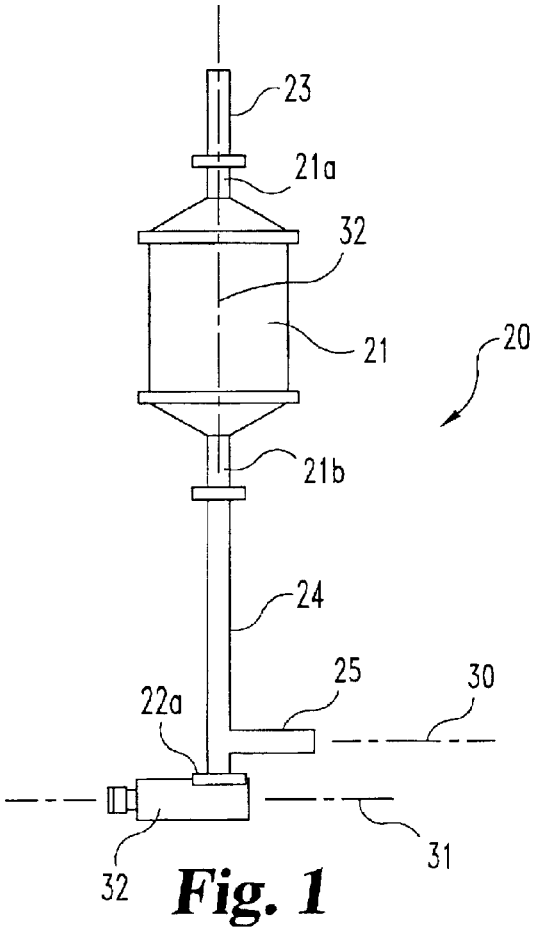
FIG. 1 is a diagrammatic, front elevational view of an exhaust system for a diesel engine according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
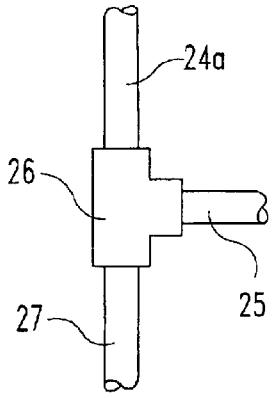
FIG. 1A is a diagrammatic illustration of a T-connection which may be utilized as part of the FIG. 1 exhaust system in an alternative arrangement.

Referring to FIG. 1, there is illustrated a diesel engine exhaust system 20 which includes a particulate filter 21 and an ash collection or catch basin 22. Portions of the exhaust pipes or conduits typical with a diesel engine exhaust system or network are included in FIG. 1 as part of system 20. These exhaust pipes or conduits include pipe sections or pipes 23, 24, and 25. Exhaust pipe 23 extends between the exhaust outlet 21*a* of the particulate filter 21 and the atmosphere. Exhaust pipe 24 extends between the exhaust inlet 21*b* of particulate filter 21 and the ash inlet 22*a* of catch basin 22. Exhaust pipe 25 extends between a point of flow connection with exhaust pipe 24 and the diesel engine (not illustrated). Due to the right angle connection between exhaust pipes 24 and 25, a T-connection 26 may be utilized (see FIG. 1A) in which exhaust pipes 24 (now identified as 24*a*) and 25 are inserted into the T-connection 26, as illustrated, and a new section of pipe, exhaust pipe 27, is used to connect between the T-connection 26 and the inlet 22*a* of the catch basin 22.

In the context of the present invention, it has been learned that particulate filters of the type discussed herein also collect the residuals of the oxidation by-products in the form of ash or other deposits that are not combustible. These ash deposits and other by-products are collected in the filter channels resulting in a blockage that does not allow the exhaust gases to pass through the particulate filter. In turn, this blockage results in excessive exhaust back pressure that reduces engine performance and can lead to engine shutdown.

In operation, the exhaust gases from the engine, via exhaust pipe 25, pass to and through particulate filter 21, via pipe 24, allowing the particulate filter 21 to collect and oxidize carbonaceous and hydrocarbon compounds that comprise the particulate emissions in the exhaust. The filtered exhaust gases flow through exhaust pipe 23 and pass upwardly into the atmosphere. The flow of exhaust gases from the engine may attempt to enter the catch basin 22. However, the catch basin is closed during engine operation except for inlet 22*a* and once filled with exhaust gas, additional exhaust gases flow through the particulate filter 21 and exit to the atmosphere. As far as the flow dynamics, it will be seen that the exhaust gases from the engine pass in an "upward" direction through pipe 24 to filter 21. This same pipe 24 is used for the passage of ash deposits from filter 21 to catch basin 22, as will be described in greater detail hereinafter. The ash particles that accumulate on the filter element are agglomerates consisting of non-combustible materials contained in lube oil and fuel. During high exhaust flow conditions, it is believed that the agglomerates remain on the surface of the filter element. This is due in part to the fact that the velocity of the exhaust flow is high enough to prevent the ash deposits from dropping down through pipe 24 against the upward flow. Under low power conditions, the exhaust gas flow is low enough to allow the ash deposits to fall down (shaken loose due to vibrations) through pipe 24 into catch basin 22.

In the context of the present invention, suitable filters for particular filter 21 include the Johnson-Matthey CRT filter and the Engelhard catalyzed DPX filter. The Continuously Regenerating Technology (CRT) filter of Johnson-Matthey (of Taylor, Mich.) is a particulate filter that contains a platinum catalyst. This filter is modularly engineered as a totally passive emission control system arranged into two chambers. The oxidation step is separate from the soot collection/combustion process.

The DPX soot filter of Engelhard (of Iselin, N.J.) is designed to address particulate emission problems from heavy duty diesel engines. A proprietary catalyst coating is used to "burn" the soot upon contact. A wall-flow monolith filter is used to trap the particulate.

It should also be noted that the orientation of exhaust system 20 relative to horizontal (ground level) and vertical is important. Exhaust systems are typically identified as either "horizontal" or "vertical" systems depending on how they are oriented relative to the typical horizontal orientation of the vehicle. In FIG. 1, this horizontal plane or orientation of the vehicle is represented by the orientation of exhaust pipe 25, axis 30, and by the longitudinal axis or centerline 31 of the catch basin. In this regard, it is assumed that the normal operating orientation of the vehicle or of the diesel engine will place the particulate filter 21 in a generally vertical orientation relative to ground. In view of the right angle connection between exhaust pipes 24 and 25, with or without T-connection 26, the longitudinal axis 32 of particulate filter 21 is illustrated in this vertical orientation and as such corresponds to the direction of gravitational pull.

By specifically designing engine exhaust system 20 such that the particulate filter 21 has a generally vertical orientation, the disclosed diesel engine exhaust system 20 achieves a novel and unobvious result. By configuring the exhaust system 20 in the manner illustrated, engine vibrations and vehicle vibrations from bumps and road unevenness create a shaking action that actually loosens the ash and other deposits which are collected in the particulate filter, allowing the action of gravity to take over. The loosened ash and other deposits fall down (by means of gravitational pull) through exhaust pipe 24 (see FIG. 1) into catch basin 22.

If the T-connection 26 is used, the loosened ash and other deposits fall down through exhaust pipe 24*a*, T-connection 26, and exhaust pipe 27 (see FIG. 1A) into catch basin 22. Since the catch basin 22 is closed except for inlet 22*a*, the ash and other deposits are collected and held for removal at a later time. When the ash and other deposits are removed, they are available for analysis and/or disposal.

In the context of the present invention, it is contemplated that the particulate filter 21 will be used in a vertical exhaust system and actually replace the muffler of such a system. The muffler is typically located at the rear of the cab. This location for the particulate filter 21 enables the desired vertical orientation and space (on the exterior) to make the catch basic 22 accessible. The particulate filter is attached to the existing exhaust pipes (equivalent to pipes 23, 24 and 25) using the existing system clamps. Regarding the replacement of the traditional muffler by means of filter 21, it should be noted that filter 21, alone, is an excellent muffler. However, if additional noise control is required, baffles can be integrated into the filter housing, similar to a conventional muffler. In this way, filter 21 provides both emissions control as well as noise control.

Figure 2:
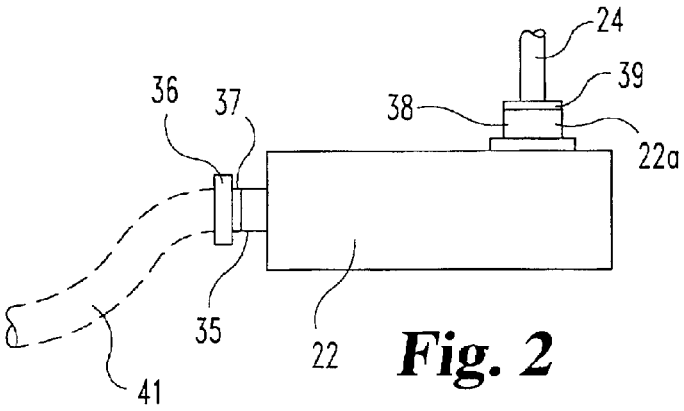
FIG. 2 is a side elevational view in partial section of a catch basin comprising one component of the FIG. 1 exhaust system.

Referring now to FIG. 2, the catch basin 22 and its connections are illustrated in greater detail. In addition to inlet 22*a*, the catch basin 22 includes an optional access port or outlet 35 which is closed with a cooperating and removable cover 36 which is secured in position with a suitable band clamp or V-band 37. In view of the temperatures and pressures which are associated with exhaust systems of the type described herein, and in view of the shock and vibrations to be experienced, the catch basin 22 is preferably of a metal construction.

In the FIG. 1 embodiment, exhaust pipe 24 is securely connected to inlet conduit 38 by the use of a suitable band clamp or V-band 39. Exhaust pipe 24 telescopingly fits into conduit 38 and the V-band holds this connection in position. In the FIG. 1A embodiment, exhaust pipe 24*a* telescopingly fits into conduit 38 and the V-band holds this connection in position.

Once the V-band 39 is removed, the catch basin 22 can be removed from the exhaust system 20. It is then possible to empty the collected ash and other deposits. While manually shaking the catch basin, while inverted, is one way to empty the catch basin 22, a vacuum can also be used. The V-bands 39, of the type described herein, are commonly used in exhaust systems to join together various components. Removal and re-installation of the V-bands is achieved by the use of basic hand tools.

The optional outlet 35 is designed as to its size, shape (cylindrical) and location to cooperate with a shop vacuum cleaner so that vacuum suction can be used to empty the catch basin without having to disconnect the catch basin from the remainder of the exhaust system 20. The vacuum hose 41 is illustrated in FIG. 2 in broken line form.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An exhaust system for a diesel engine comprising:

a particulate filter for filtering a flow of engine exhaust gas;

a catch basin for the collection of oxidation by-products from said particulate filter;

a first flow conduit extending between said particulate filter and said catch basin;

a second flow conduit extending between said first flow conduit and said diesel engine; and means for orienting said particulate filter in a generally vertical orientation based on the normal orientation of said diesel engine when in use, whereby engine exhaust gas flows through said first flow conduit toward said particulate filter and said oxidation by-products flow through said first flow conduit away from said particulate filter.

2. The exhaust system of claim 1 wherein said catch basin includes an inlet and said first flow conduit is connected to said inlet.

3. The exhaust system of claim 2 wherein said catch basin includes an outlet which is constructed and arranged for enabling removal of the collected oxidation by-products.

4. The exhaust system of claim 3 which further includes a third flow conduit having a first end in flow communication with said particulate filter and a second end opening to atmosphere.

5. The exhaust system of claim 4 which further includes a removable closing cover attached to the outlet of said catch basin.

6. The exhaust system of claim 1 wherein said catch basin includes an outlet which is constructed and arranged for enabling removal of the collected oxidation by-products.

7. The exhaust system of claim 6 which further includes a removable closing cover attached to the outlet of said catch basin.

8. The exhaust system of claim 1 which further includes a third flow conduit having a first end in flow communication with said particulate filter and a second end opening to atmosphere.

9. A method of collecting oxidation by-products from a particulate filter which is used for filtering exhaust gas from a diesel engine, said method comprising the following steps:

(a) providing a particulate filter;

(b) providing a catch basin for collecting oxidation by-products from said particulate filter;

(c) orienting said particulate filter in a generally vertical orientation based on the normal orientation of said diesel engine when in use;

(d) providing a first flow conduit;

(e) connecting said first flow conduit between said particulate filter and said catch basin for the collection in said catch basin of oxidation by-products from said particulate filter;

(f) providing a second flow conduit; and (g) connecting said second flow conduit between said first flow conduit and said diesel engine.

10. A method of removing collected oxidation by-products from a catch basin which is connected to a particulate filter which is connected to a diesel engine, said method comprising the following steps:

(a) constructing and arranging said catch basin with an inlet conduit to receive said oxidation by-products;

(b) providing an outlet as part of said catch basin, said outlet including a removable cover;

(c) removing said cover from said outlet;

(d) connecting a shop vacuum cleaner to said outlet; and (e) operating said shop vacuum cleaner for suctioning said oxidation by-products out of said catch basin.

11. The method of claim 10 which includes the step of replacing said cover over said outlet.

* * * * *